US007326443B2

(12) United States Patent
Schultheis et al.

(10) Patent No.: US 7,326,443 B2
(45) Date of Patent: Feb. 5, 2008

(54) METHOD AND DEVICE FOR HEATING AND FIXING AN INKING, PARTICULARLY A TONER POWDER ON A PLATE-SHAPED SUPPORT

(75) Inventors: Bernd Schultheis, Schwabenheim (DE); Rainer Solbach, Langenbach (DE); Birgit Lattermann, Ried-Stadt (DE); Hans-Jürgen Hommes, Herkersdorf (DE); Dieter Jung, Daaden (DE)

(73) Assignee: Schott Glas, Mainz (DE)

( * ) Notice: Subject to any disclaimer, the term of this patent is extended or adjusted under 35 U.S.C. 154(b) by 425 days.

(21) Appl. No.: 10/472,557

(22) PCT Filed: Mar. 21, 2002

(86) PCT No.: PCT/EP02/03115

§ 371 (c)(1),
(2), (4) Date: Sep. 19, 2003

(87) PCT Pub. No.: WO02/077720

PCT Pub. Date: Oct. 3, 2002

(65) Prior Publication Data

US 2005/0100812 A1 May 12, 2005

(30) Foreign Application Priority Data

Mar. 22, 2001 (DE) ..... 101 14 526

(51) Int. Cl.
*B05D 3/06* (2006.01)
*B05B 13/00* (2006.01)

(52) U.S. Cl. ..... 427/553; 427/189; 427/372.2; 427/375; 427/377; 427/378; 118/620; 118/641

(58) Field of Classification Search ..... 427/372.2
See application file for complete search history.

(56) References Cited

FOREIGN PATENT DOCUMENTS

| | | |
|---|---|---|
| DE | 2 261 116 | 6/1973 |
| DE | 40 34 499 A1 | 5/1991 |
| DE | 198 57 044 A1 | 4/2000 |
| EP | 0 989 473 A2 | 3/2000 |
| JP | 08-227240 A * | 9/1996 |

* cited by examiner

*Primary Examiner*—William Phillip Fletcher, III
(74) *Attorney, Agent, or Firm*—Pauley Petersen & Erickson

(57) ABSTRACT

A method for heating and fixing an inking, particularly a toner powder on a plate-shaped support. Heat is applied and fixes the inking to a coated upper side of the support. The method of this invention can be used to fix and adhere toner inkings on thick-walled supports. In one method step of this invention, the coated upper side and/or an uncoated underside of the plate-shaped support each is subjected to infrared radiation and/or a hot air stream and/or a microwave radiation. At least a portion of the infrared radiation and/or the hot air stream and/or the microwave radiation directed onto the uncoated underside of the support passes through while another portion is absorbed, such as if the support has a high weight per unit area of the support. A ceramic or thermosetting toner forms the applied ink.

36 Claims, 4 Drawing Sheets

METHOD AND DEVICE FOR HEATING AND FIXING AN INKING, PARTICULARLY A TONER POWDER ON A PLATE-SHAPED SUPPORT

BACKGROUND OF THE INVENTION

1. Field of the Invention

This invention relates to a method for heating and fixing applied ink, in particular a toner powder, on a plate-shaped support, wherein the ink applied to the coated surface of the support is fixed on the support applying the application of heat, as well as a device for executing the method.

2. Discussion of Related Art

The use of infrared radiation for heating and fixing an ink application on a paper or a sheet-shaped support is known from German Patent Reference DE 198 57044 A1. The short-wave infrared radiation here has a typical emission temperature of 2000 to 2500 K. Paper has a low weight per surface unit, which is less than 100 g/m$^2$ as a rule.

A further method for toner fixation is known from European Patent Reference EP 0 989 473 A2. In this case the toner powder is fixed on the paper by an inductively heated roller.

In this known method, a thin copying paper is heated relatively quickly, because it also has a weight per surface unit<100 g/m$^2$. Thick-walled plate-shaped materials, such as glass or ceramic plates, plastic plates, etc. cannot easily be heated up in this way, because they have a clearly higher weight per surface unit and therefore a clearly higher heat capacity.

SUMMARY OF THE INVENTION

It is one object of this invention to provide a method and a device, by which toner powder, in particular ceramic and thermosetting toner powders, can be fixed with good adhesion on plate-shaped materials of high weight per surface unit.

In accordance with this invention, this object is attained by a method in which the coated surface and/or the non-coated underside of the plate-shaped support are acted upon by infrared radiation and/or a hot air flow and/or microwave radiation, and a support of high weight per surface unit is used, which allows a portion of the action directed to the non-coated underside of the support through and absorbs another portion.

The introduction of energy occurs as needed over the coated surface of the support, as well as the non-coated underside of the support as an action by infrared radiation, a hot air flow and microwave radiation, which can be variably selected. The support allows a portion of the action through and absorbs a portion. Action on the underside of the support causes, for one, the uniform heating of the material of the support because of the partial absorption and, also, an increased absorption in the toner powder takes place at the interface between the applied ink and the support, which leads to improved melting of the toner powder and thus also leads to improved adhesion on the support. The energy introduction is also independent to a large extent of the degree of toner application and of the type of the toner powder, which is particularly advantageous in connection with thermoplastic, thermosetting or ceramic toner powders. The plate-shaped support has a weight per surface unit of >100 g/m$^2$, in particular >1000 g/m$^2$.

In accordance with one embodiment, a transparent material, such as glass, a glass-ceramic material or plastic is used for the support, which has a transmission >20%, preferably >50%, in the spectral range of a wavelength of 0.8 μm to 5 μm. Materials of a thickness between 3 and 8 mm and with a relative smooth surface, which is difficult to wet, are particularly suited for this purpose, if a ceramic or thermosetting toner powder is used for the applied ink.

The fixation of the toner powder on such supports can also be improved if the coated surface and/or the non-coated underside of the support are subjected to a hot air flow, which is preferably directed in a focused manner on the applied ink if the support has a reduced transmission degree for this purpose. The support can be subjected to microwave radiation on the coated surface and/or the non-coated underside, whose frequency substantially corresponds to the resonance frequency (microwave coupling frequency) of the molecular structure of the support.

Fixation can occur by a device for executing the method while the support is standing still or is continuously moved, wherein for one, the support provided with applied ink is introduced into a chamber which, on the coated surface and/or the non-coated underside of the support has transmission devices for selectively acting on the support, while on the other hand for the process the support can be moved through a pass-through chamber, which has transmission devices for the selective action on the support on the coated surface and/or the non-coated underside of the support.

In accordance with one embodiment, a simple device with infrared radiators arranged on both sides has the transmission devices on the coated surface and/or the non-coated underside of the support arranged at a uniform spacing, wherein the arrangement on both sides offsets the transmission devices of the surface and the underside by half a space with respect to each other. Also, several infrared radiators as transmission devices are arranged on both sides of the support, and the sides of the infrared radiators facing away from the support are enclosed in partial reflectors in the shape of a semicircle.

The infrared radiators extend over the entirety of the applied ink on the stationary support, or they form a passage which, with the speed of the support and its length, assures sufficient heating and fixation time. The partial reflectors focus the radiation on the applied ink and also direct radiation reflected by the support back to the support. It is possible to combine the partial reflectors assigned to the coated surface of the support into a reflection unit.

If the support is moved past the infrared beams on a roller track, the device is embodied so that the partial reflectors assigned to the non-coated underside of the support are respectively arranged between two transport rollers of a roller track.

If the toner powder on the support is subjected to a hot air flow, the partial reflectors of the reflector unit have air flow-through openings and close off inflow chambers, to which hot air can be supplied by a hot air blower via feed lines, and between the partial reflectors the reflector unit delimits suction chambers having suction openings, which are connected via suction lines with the hot air blower.

The coated support can be introduced into a microwave chamber, or can pass through such a chamber, and can be acted upon by a microwave radiation of 2.54 GHz, which is cleared for industrial purposes. This can occur prior to or after the radiation with infrared radiation, or simultaneously with it. It is a prerequisite in this case that this microwave frequency substantially correspond to the resonance frequency (microwave coupling frequency) of the molecular structure of the support, which is the case particularly with support materials made of an aluminum silicate glass-ceramic material in a high quartz mixed crystal (HQMC) modification.

But an action on the coated surface of the support can also occur with only a directed or focused hot air flow. Depending on the material of the support, an action on only the non-coated underside with microwave radiation is also possible.

BRIEF DESCRIPTION OF THE DRAWINGS

This invention is explained in greater detail in view of exemplary embodiments shown in the drawings, wherein.

DESCRIPTION OF PREFERRED EMBODIMENTS

Figure 1:
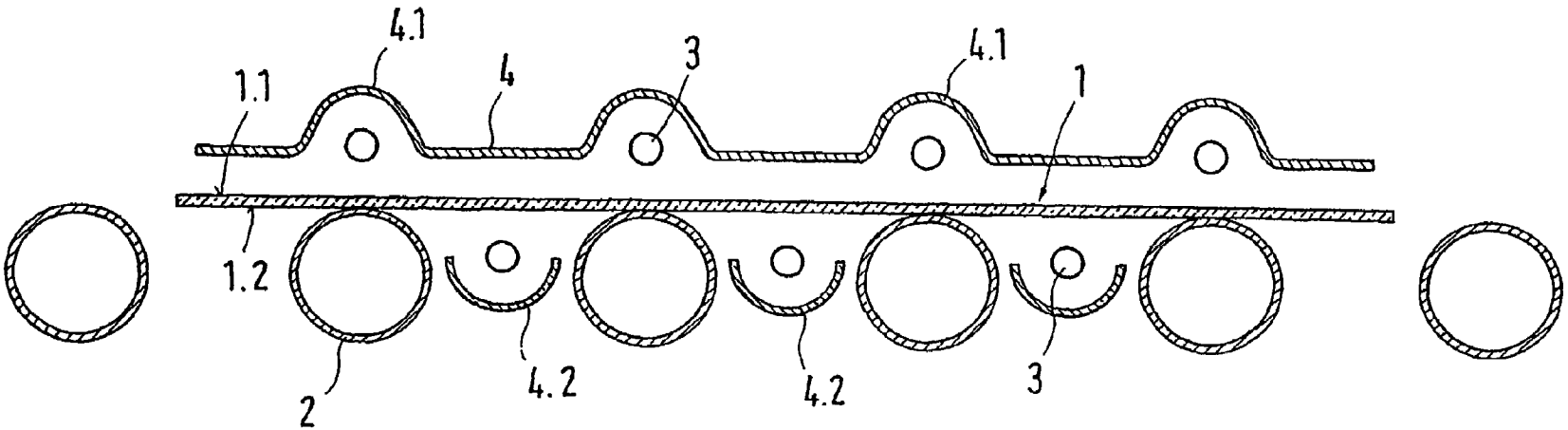
FIG. 1 is a sectional view of a pass-through device with a pass-through chamber and infrared radiators arranged on both sides.

The method in accordance with this invention is used with the pass-through device in accordance with FIG. 1, because the support 1 passed through is acted upon on the coated surface 1.1 and the non-coated underside 1.2 by an infrared radiation emanating from infrared radiators 3 arranged on both sides of the support 1. Several infrared radiators with uniform spacing, but offset with respect to each other by half a space, are assigned to the surface and the underside 1.1 and 1.2 of the support 1. The support 1 is moved here by transport rollers 2. The speed of this movement and the length of this "pass-through chamber" are matched so that sufficient time for irradiation and fixation is assured. The infrared radiators 3 are each arranged in semicircular-shaped partial reflectors 4.1, or 4.2, so that focusing of the radiation in the direction of the support occurs, and radiation reflected by the support 1 is reflected back again. The partial reflectors 4.1 on the coated surface 1.1 of the support 1 are combined into a reflector unit 4, while on the non-coated underside 1.2 of the support 1 the partial reflectors 4.2 are always arranged between two transport rollers 2.

The infrared radiators 3 are embodied, for example, as dark radiators, halogen radiators, quartz radiators or carbon radiators, whose radiation maximum lies between 0.8 μm and 5 μm, and having respective emission temperatures between 1000 K and 3750 K. The thickness of the support can be selected to lie in the range between 3 mm and 8 mm. Glass or glass-ceramic material with a transmission >20%, preferably >50%, of the short-wave infrared radiation is particularly well suited as the support material. Other materials with a sufficiently large transmission of infrared radiation can be used with an equally good effect.

In a further preferred embodiment the radiators are embodied as ceramic radiators having a radiation maximum between 3.5 and 4 μm and a radiation temperature in the range between 500 and 600° C.

Figure 2:
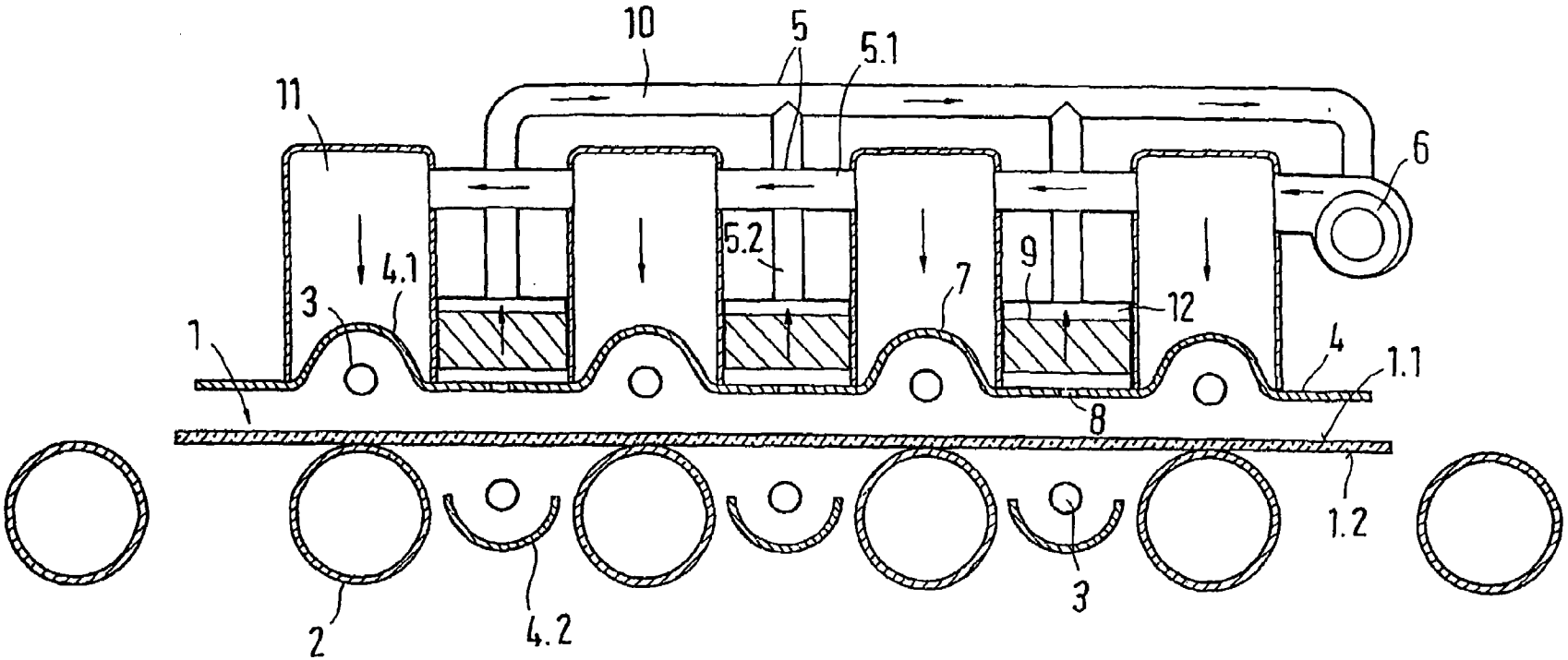
FIG. 2 is a sectional view of the pass-through device in accordance with FIG. 1 but with an additional action on the surface by means of a hot air flow.

In the embodiment in accordance with FIG. 2 the construction with the transport roller 2, the infrared radiators 3 and the partial reflectors 4.1 and 4.2 is identical for all practical purposes. However, for heating and fixing the toner powder on the coated surface 1.1 of the support 1, a hot air flow 10 is conducted additionally over the applied ink of the support 1 and is kept circulating in a line system 5 by a hot air blower 6. The partial reflectors 4.1 of the reflector unit 1 enclose inflow chambers 11, which are supplied with hot air via feed lines 5.1. The hot air leaves the inflow chambers 11 by way of air flow-through openings 7 of the partial reflectors 4.1 and additionally heats the applied ink. The reflector unit 4 has suction openings 8 between the partial reflectors 4.1, through which the hot air is aspirated into suction chambers 12. The aspirated air is guided over filters 9 and impurities contained in it are kept back. The air, which is freed of impurities and is cooled, returns via suction lines 5.2 back to the hot air blower 6, where it is again supplied to the circulation 5 after it is heated and its pressure is increased. The action of additional hot air on the applied ink results in an improved heating time, and thus also toner fixation. The hot air blower 6 can be embodied as a radial blower, which axially aspirates air from the suction lines 5.2 and provides it, heated up, radially to the feed lines 5.1.

As mentioned, the method can also be applied in a device without transport rollers and embodied as a receiving chamber. The partial reflectors 4.2 are then also combined into a reflector unit, and the support 1 is introduced into the receiving chamber and is subjected to the infrared radiation and/or the hot air flow for a predetermined length of time. The combination of hot air and/or microwave radiation can be selected as needed, wherein the material, the thickness and the transmission degree of the support 1 must be considered.

Figure 3:
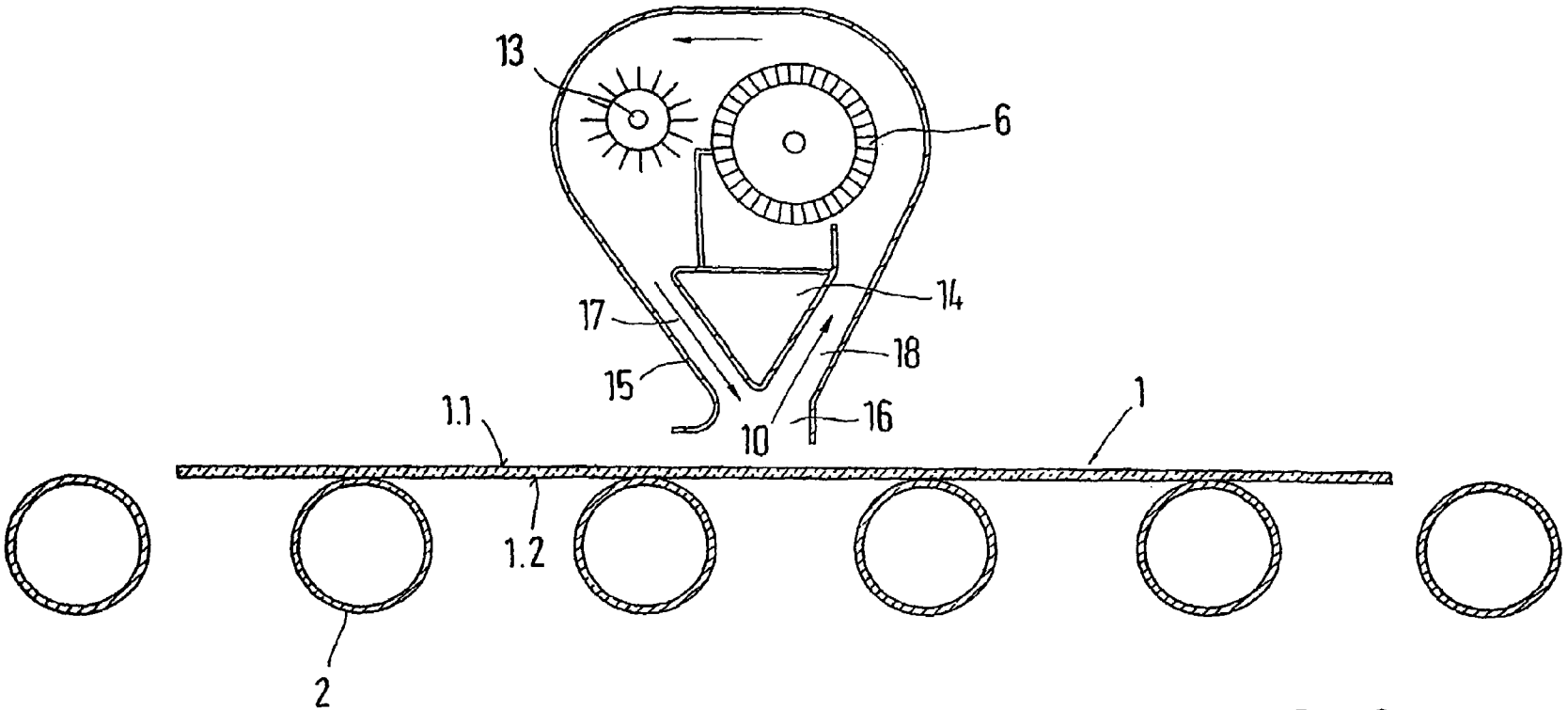
FIG. 3 is a sectional view of a device wherein hot air acts on the coated surface.

In the embodiment of the device in accordance with FIG. 3, a directed and focused hot air flow 10 acts on the coated surface 1.1 of the support 1. In this case the support 1 is moved past the stationary hot air blower 6 in a housing 15 on transport rollers 2. In this case the air flow generated by the hot air blower 6 is additionally heated by a heater 13, and is conducted in a directed manner via a guide element 14 to an outflow opening 16. Together with the housing 15, the guide element 14 forms an outflow conduit 17 and an aspirating conduit 18 for the air flow 10.

Figure 4:
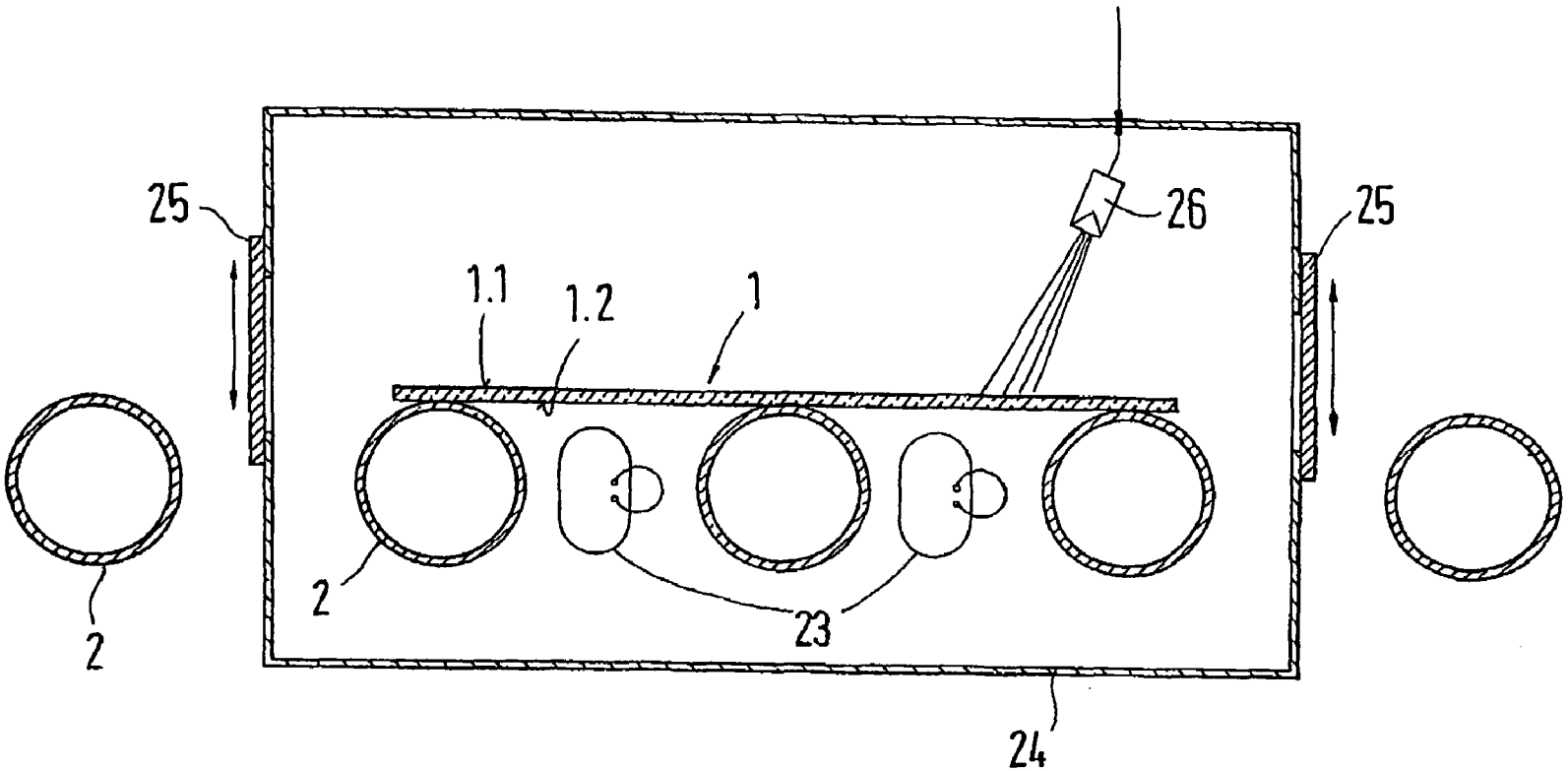
FIG. 4 is a sectional view of a device with a microwave chamber.

A microwave chamber 24 is shown in FIG. 4, wherein the support 1 can be introduced and removed via closing members 25. While the non-coated underside 1.2 of the support is acted upon, the closing members 25 remain closed. The microwave chamber 24 is shielded toward the outside, so that the microwave radiation only occurs in the inner chamber. Transport rollers 2 take on the transport of the support 1 into and out of the microwave chamber 24. Microwave klystrons 23 are arranged between the transport rollers 2, which are controlled by a pyrometer 26. Pyrometers, in particular those which are sensitive in the spectral range of wavelengths around 5.5 μm, or in the range between 7.5 and 8.2 μm, are particularly well suited for monitoring the surface temperature of glass or glass-ceramic materials. Because of the relative good coupling of support materials made of an aluminum silicate glass ceramic material by means of high quartz mixed crystal modification (HQMC), temperature monitoring is particularly important in order to prevent overheating of the toner material and the support material.

Moreover, pyrometers have one advantage of being relatively insensitive to microwave radiation.

The invention claimed is:

1. A method for heating and fixing an applied ink on a plate-shaped support (1), wherein the ink applied to a coated surface of the support (1) is fixed on the support (1) by applying heat, wherein the coated surface (1.1) and a non-coated underside (1.2) of the plate-shaped support (1) are acted upon by at least one of an infrared radiation, a hot air flow and a microwave radiation, and the support (1) has a weight per surface unit of greater than 500 g/m$^2$ allowing a portion of the at least one of the infrared radiation, the hot air flow and the microwave radiation directed to the non-coated underside (1.2) of the support (1) through and absorbing another portion thereof, and the applied ink is formed from a ceramic or thermosetting toner.

2. The method in accordance with claim 1, wherein one of a transparent material, a glass, a glass-ceramic material and a plastic is used for the support (1), which has a transmission greater than 20%, in a spectral range of a wavelength of 0.8 μm to 5 μm, and an absorption spectrum in a wavelength range of approximately 3.2 to 3.8 μm.

3. The method in accordance with claim 2, wherein the coated surface (1.1) and the non-coated underside (1.2) of the support (1) are subjected to a hot air flow (10) directed on the applied ink.

4. The method in accordance with claim 3, wherein the transmission of the support (1) is greater than 50%.

5. The method in accordance with claim 4, wherein a microwave radiation having a frequency corresponding to one of a resonance frequency and a microwave coupling frequency of the molecular structure of the support (1) acts on at least one of the coated surface (1.1) and the non-coated underside (1.2) of the support (1).

6. The method in accordance with claim 5, wherein the support (1) is made of aluminum silicate in a high quartz mixed crystal (HMQC) modification, and the microwave radiation frequency is 2.54 GHz.

7. A device for executing the method in accordance with claim 6, wherein the support (1) with the applied ink is introduced into a chamber which has transmission devices for selectively acting on at least one of the coated surface (1.1) and the non-coated underside (1.2) of the support (1).

8. The device in accordance with claim 7, wherein at least one of the transmission devices is disposed on a side of each of the coated surface (1.1) and the non-coated underside (1.2) of the support (1), and the transmission devices are arranged in a uniform spacing wherein the transmission devices of the coated surface (1.1) and the non-coated underside (1.2) are offset by one half of a space with respect to each other.

9. The device in accordance with claim 7, wherein infrared radiators (3), hot air blowers (6) and microwave generators are used as the transmission devices.

10. The device in accordance with claim 7, wherein a plurality of infrared radiators (3) as transmission devices are disposed on opposing surfaces of the support (1), and sides of the infrared radiators (3) facing away from the support (1) are enclosed in partial reflectors (4.1, 4.2).

11. The device in accordance with claim 7, wherein the infrared radiators are ceramic radiators each of which has the maximum in the radiation spectrum between 3.5 and 4 μm wavelength and a radiation temperature in the range between 500° C. and 600° C.

12. The device in accordance with claim 7, wherein the support (1) is movable through a pass-through chamber, which includes the transmission devices.

13. The device in accordance with claim 12, wherein a housing (15) with a hot air blower (6) and a heater (13) is assigned to the coated surface (1.1) of the support (1), which has an outflow opening (16) for the hot air flow (10), the support (1) is moveable past the outflow opening (16), and an outflow conduit (17) and an aspirating conduit (18) are formed by a guide element (14) in an area of the outflow opening (16).

14. The device in accordance with claim 12, wherein the support (1) is introducible into a shielded microwave chamber (24), which can be opened and closed by closing members (25), and with each closing member (25) closed, microwave radiation from microwave klystrons (23) is applied to the non-coated side (1.2) of the support, and the microwave klystrons (23) are controlled by a pyrometer (26) housed in the microwave chamber (26).

15. The device in accordance with claim 12, wherein at least one of the transmission devices is disposed on a side of each of the coated surface (1.1) and the non-coated underside (1.2) of the support (1), and the transmission devices are arranged in a uniform spacing wherein the transmission devices of the coated surface (1.1) and the non-coated underside (1.2) are offset by one half of a space with respect to each other.

16. The device in accordance with claim 15, wherein a housing (15) with a hot air blower (6) and a heater (13) is assigned to the coated surface (1.1) of the support (1), which has an outflow opening (16) for the hot air flow (10), the support (1) is moveable past the outflow opening (16), and an outflow conduit (17) and an aspirating conduit (18) are formed by a guide element (14) in an area of the outflow opening (16).

17. The device in accordance with claim 15, wherein the support (1) is introducible into a shielded microwave chamber (24), which can be opened and closed by closing members (25), and with each closing member (25) closed, microwave radiation from microwave klystrons (23) is applied to the non-coated side (1.2) of the support, and the microwave klystrons (23) are controlled by a pyrometer (26) housed in the microwave chamber (26).

18. The device in accordance with claim 17, wherein the microwave klystrons (23) are arranged between transport rollers (2) for the support (1).

19. The device in accordance with claim 15, wherein infrared radiators (3), hot air blowers (6) and microwave generators are used as the transmission devices.

20. The device in accordance with claim 19, wherein the infrared radiators (3) are one of halogen radiators, quartz radiators and carbon radiators, each having a maximum in a radiation spectrum between 0.8 μm and 5 μm wavelength, and a radiation temperature in the range between 1000 K and 3750 K.

21. The device in accordance with claim 19, wherein a plurality of infrared radiators (3) as transmission devices are disposed on opposing surfaces of the support (1), and sides of the infrared radiators (3) facing away from the support (1) are enclosed in partial reflectors (4.1, 4.2).

22. The device in accordance with claim 21, wherein the partial reflectors (4.2) assigned to the non-coated underside (1.1) of the support (1) are respectively arranged between two transport rollers (2) of a roller track.

23. The device in accordance with claim 21, wherein the partial reflectors (4.1) of the reflector unit (4) have air flow-through openings (7) and close off inflow chambers (11) to which hot air can be supplied by a hot air blower (6) via feed lines (5.1), and between the partial reflectors (4.1) the reflector unit (4) delimits suction chambers (12) having suction openings (8) which are connected via suction lines (5.2) with the hot air blower (6).

24. The device in accordance with claim 21, wherein the partial reflectors (4.1) assigned to the coated surface (1.1) of the support (1) are combined into a reflector unit (4).

25. The device in accordance with claim 24, wherein the partial reflectors (4.2) assigned to the non-coated underside (1.2) of the support (1) are respectively arranged between two transport rollers (2) of a roller track.

26. The device in accordance with claim 25, wherein the partial reflectors (4.1) of the reflector unit (4) have air flow-through openings (7) and close off inflow chambers (11) to which hot air can be supplied by a hot air blower (6) via feed lines (5.1), and between the partial reflectors (4.1) the reflector unit (4) delimits suction chambers (12) having suction openings (8) which are connected via suction lines (5.2) with the hot air blower (6).

27. The device in accordance with claim 26, wherein the hot air blower (6) is a radial blower which aspirates the hot air from the suction lines (5.2) and returns the hot air radially to the feed lines (5.1).

28. The device in accordance with claim 26, wherein hot air aspirated from the suction chambers (12) is returned via filters (9) to the hot air blower (6).

29. The device in accordance with claim 28, wherein the hot air blower (6) is a radial blower which aspirates the hot air from the suction lines (5.2) and returns the hot air radially to the feed lines (5.1).

30. The device in accordance with claim 29, wherein the infrared radiators (3) are one of halogen radiators, quartz radiators and carbon radiators, each having a maximum in a radiation spectrum between 0.8 μm and 5 μm wavelength, and a radiation temperature in the range between 1000 K and 3750 K.

31. The device in accordance with claim 29, wherein the infrared radiators are ceramic radiators each of which has the maximum in the radiation spectrum between 3.5 and 4 μm wavelength and a radiation temperature in the range between 500° C. and 600° C.

32. The method in accordance with claim 1, wherein the coated surface (1.1) and the non-coated underside (1.2) of the support (1) are subjected to a hot air flow (10) directed on the applied ink.

33. The method in accordance with claim 1, wherein the support (1) has a transmission degree greater than 50% in a spectral range of a wavelength of 0.8 μ m to 5 μm.

34. The method in accordance with claim 1, wherein a microwave radiation having a frequency corresponding to one of a resonance frequency and a microwave coupling frequency of the molecular structure of the support (1) acts on at least one of the coated surface (1.1) and the non-coated underside (1.2) of the support (1).

35. A device for executing the method in accordance with claim 1, wherein the support (1) with the applied ink is introduced into a chamber which has transmission devices for selectively acting on at least one of the coated surface (1.1) and the non-coated underside (1.2) of the support (1).

36. The device in accordance with claim 1, wherein the support (1) is movable through a pass-through chamber, which includes transmission devices for the at least one of the infrared radiation, the hot air flow and the microwave radiation.

* * * * *